US007097417B2

(12) United States Patent
Liang

(10) Patent No.: US 7,097,417 B2
(45) Date of Patent: Aug. 29, 2006

(54) COOLING SYSTEM FOR AN AIRFOIL VANE

(75) Inventor: George Liang, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 231 days.

(21) Appl. No.: 10/774,906

(22) Filed: Feb. 9, 2004

(65) Prior Publication Data

US 2005/0175444 A1 Aug. 11, 2005

(51) Int. Cl.
*F01D 25/12* (2006.01)

(52) U.S. Cl. ..... 415/115

(58) Field of Classification Search ..... None
See application file for complete search history.

(56) References Cited

U.S. PATENT DOCUMENTS

| | | | | |
|---|---|---|---|---|
| 4,017,213 | A | 4/1977 | Przirembel | |
| 4,726,735 | A | 2/1988 | Field et al. | |
| 4,863,348 | A | 9/1989 | Weinhold | |
| 5,135,354 | A | 8/1992 | Novotny | |
| 5,340,278 | A | 8/1994 | Magowan | |
| 5,344,283 | A | 9/1994 | Magowan et al. | |
| 5,382,135 | A | 1/1995 | Green | |
| 5,413,458 | A | 5/1995 | Calderbank | |
| 5,545,002 | A | 8/1996 | Bourguignon et al. | |
| 5,639,216 | A | 6/1997 | McLaurin et al. | |
| 6,071,075 | A | 6/2000 | Tomita et al. | |
| 6,079,946 | A | 6/2000 | Suenaga et al. | |
| 6,082,961 | A | 7/2000 | Anderson et al. | |
| 6,132,173 | A | 10/2000 | Tomita et al. | |
| 6,210,111 | B1 | 4/2001 | Liang | |
| 6,241,467 | B1 | 6/2001 | Zelesky et al. | |
| 6,254,333 | B1 | 7/2001 | Merry | |
| 6,309,175 | B1 | 10/2001 | Hahnle et al. | |
| 6,390,774 | B1 | 5/2002 | Lewis et al. | |
| 6,431,832 | B1 * | 8/2002 | Glezer et al. | 416/97 R |
| 6,431,833 | B1 | 8/2002 | Jones | |
| 6,478,540 | B1 | 11/2002 | Abuaf et al. | |
| 6,499,950 | B1 | 12/2002 | Willett et al. | |
| 6,607,355 | B1 * | 8/2003 | Cunha et al. | 416/97 R |

FOREIGN PATENT DOCUMENTS

| | | |
|---|---|---|
| EP | 0702748 B1 | 9/1998 |
| EP | 1013880 A2 | 6/2000 |

* cited by examiner

*Primary Examiner*—Ninh H. Nguyen

(57) ABSTRACT

A turbine vane for a turbine engine having a cooling system in inner aspects of the turbine vane. The cooling system includes one or more vortex forming chambers proximate to the intersection of an airfoil forming a portion of the turbine vane and an endwall to which the airfoil is attached. The intersection of the airfoil and the endwall may include a fillet for additional strength at the connection. The vortex forming chambers receive cooling fluids from cooling injection holes that provide a cooling fluid supply pathway between the cooling air supply cavity and the vortex forming chambers. The cooling fluids may be exhausted through one or more film cooling holes. The film cooling holes may exhaust cooling fluids proximate to the fillet to reduce the temperature of the external surface of the fillet and surrounding region.

17 Claims, 2 Drawing Sheets

COOLING SYSTEM FOR AN AIRFOIL VANE

FIELD OF THE INVENTION

This invention is directed generally to airfoil vanes, and more particularly to hollow turbine vanes having internal cooling channels for passing gases, such as air, to cool the vanes.

BACKGROUND

Typically, gas turbine engines include a compressor for compressing air, a combustor for mixing the compressed air with fuel and igniting the mixture, and a turbine vane assembly for producing power. Combustors often operate at high temperatures that may exceed 2,500 degrees Fahrenheit. Typical turbine combustor configurations expose turbine vane assemblies to these high temperatures. As a result, turbine vanes must be made of materials capable of withstanding such high temperatures. In addition, turbine vanes often contain cooling systems for prolonging the life of the vanes and reducing the likelihood of failure as a result of excessive temperatures.

Typically, turbine vanes are formed from an elongated portion forming a vane having one end configured to be coupled to a vane carrier at an endwall and an opposite end coupled to another endwall. The vane is ordinarily composed of a leading edge, a trailing edge, a suction side, and a pressure side. The inner aspects of most turbine vanes typically contain an intricate maze of cooling circuits forming a cooling system. The cooling circuits in the vanes receive air from the compressor of the turbine engine and pass the air through multiple flow paths designed to maintain all aspects of the turbine vane at a relatively uniform temperature. The air passing through these cooling circuits in the first stage of a turbine assembly is exhausted through orifices in the leading edge, trialing edge, suction side, and pressure side of the vane. While advances have been made in the cooling systems in turbine vanes, a need still exists for a turbine vane having increased cooling efficiency for dissipating heat.

Often times, a fillet is formed at the intersection of a turbine vane and an endwall to increase strength of the connection and to prevent premature failure of the vane at this locale. While the fillet provides additional strength to the connection, the fillet also adds material, which causes an increase in temperature of the material forming the fillet region relative to other areas forming the outer wall of the airfoil during use of the turbine vane in a turbine engine. Thus, an cooling system is needed that accounts for the difference in material thickness at the fillet region by removing the excess heat to prevent premature failure of the airfoil at the intersection of the airfoil and an endwall.

SUMMARY OF THE INVENTION

This invention relates to a turbine vane capable of being used in turbine engines and having a turbine vane cooling system for dissipating heat from the region surrounding the intersection between an airfoil and an endwall to which the airfoil is attached. The turbine vane may be a generally elongated airfoil having a leading edge, a trailing edge, a first end coupled to a first endwall for supporting the vane, a second end opposite to the first end coupled to a second endwall, and an outer wall. The turbine vane may also include at least one cavity forming a cooling system in inner aspects of the vane. The cooling system may include one or more vortex forming chambers in the outer wall of the airfoil that is located proximate to an intersection between the airfoil and the endwall for cooling the intersection between the airfoil and the endwall. In at least one embodiment, the intersection between the airfoil and the first or second endwalls may also include a fillet for attaching the airfoil to the endwall and providing strength for the connection. In at least one embodiment, the vortex forming chamber may be a continuous tube positioned around the perimeter of the airfoil and proximate to the intersection between the airfoil and the first or second endwall.

The vortex cooling chambers may receive cooling fluids through one or more cooling injection holes coupling the vortex forming chambers to a cavity of the cooling system. The cooling injection holes may be offset from a longitudinal axis of the vortex forming chamber. The cooling fluids may be exhausted from the turbine vane through one or more film cooling holes extending from the vortex forming chambers to an outer surface of the generally elongated airfoil for exhausting cooling fluids from the vortex chambers. In at least one embodiment, the film cooling holes may be positioned proximate to the fillet at the intersection between the airfoil and the first or second endwalls to provide film cooling to the outer surface of the endwall.

During operation, cooling gases flow through inner aspects of a cooling system in the vane. Substantially all of the cooling air passes through film cooling holes in the leading edge, trailing edge, pressure side and cooling side of the vane. At least a portion of the cooling air entering the cooling system of the turbine vane passes through the cooling injection holes and into the vortex forming chambers. The cooling fluids form vortices in the vortex forming chambers and remove heat from the walls forming the chambers. The cooling fluids may be exhausted through the film cooling holes and provide film cooling to the outside surface of the endwall.

An advantage of this invention is that the vortex forming chambers reduce heat from the fillet region at the intersection of an airfoil and an endwall, thereby reducing the likelihood of failure at this locale.

Another advantage of this invention is that the cooling injection holes may be sized based upon supply and discharge pressures of the cooling system.

Yet another advantage of this invention is that the vortex forming chambers and other components of the cooling system result in a higher overall cooling effectiveness of a turbine vane as compared with conventional designs at least because the vortex chambers result in a higher heat transfer convection coefficient of the cooling fluids.

Still another advantage of this invention is that the film cooling holes may be placed in close proximity to the fillet, which enables the temperature of the fillet region to be reduced.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
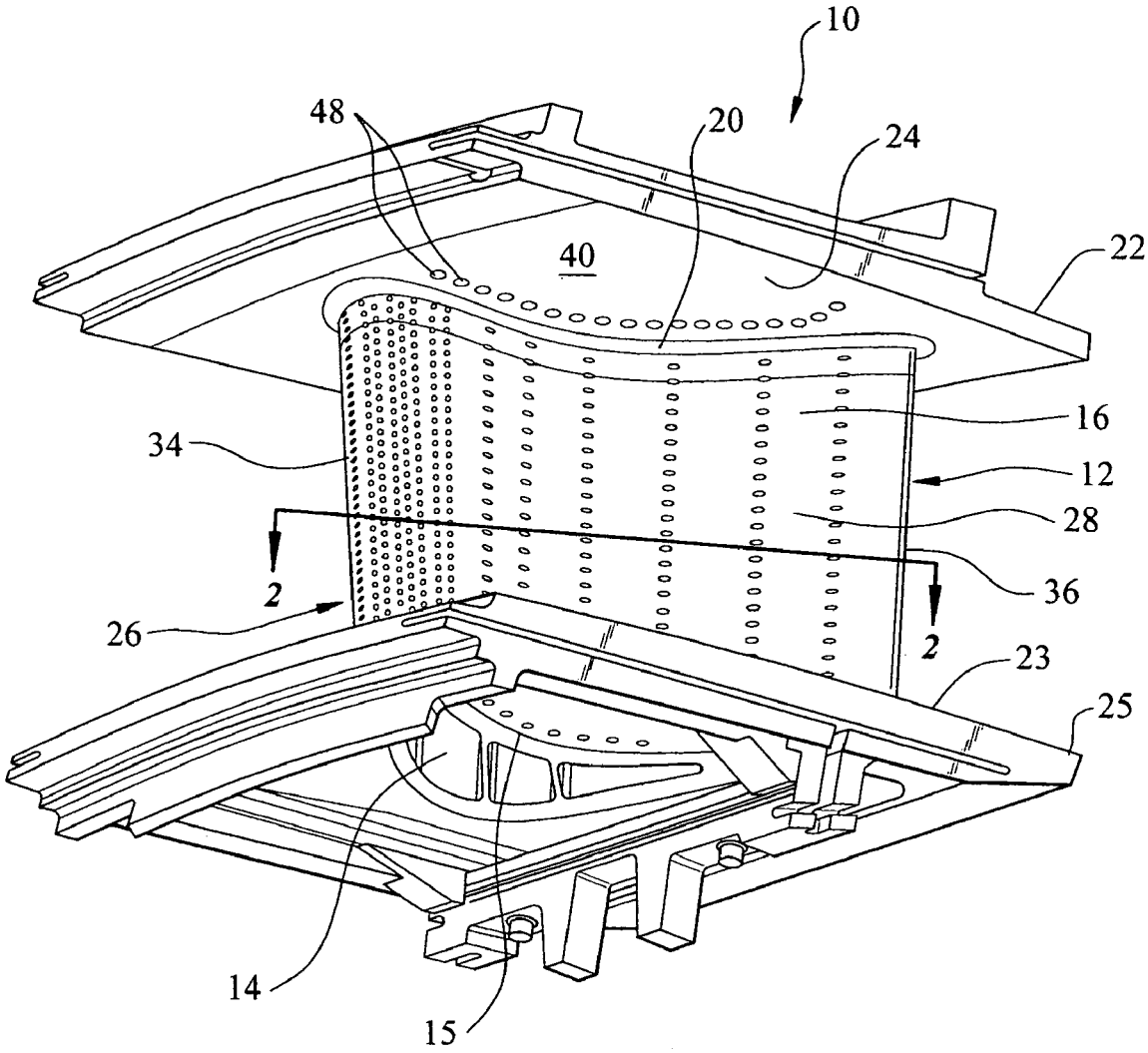
FIG. 1 is a perspective view of a turbine vane having features according to the instant invention.
Figure 2:
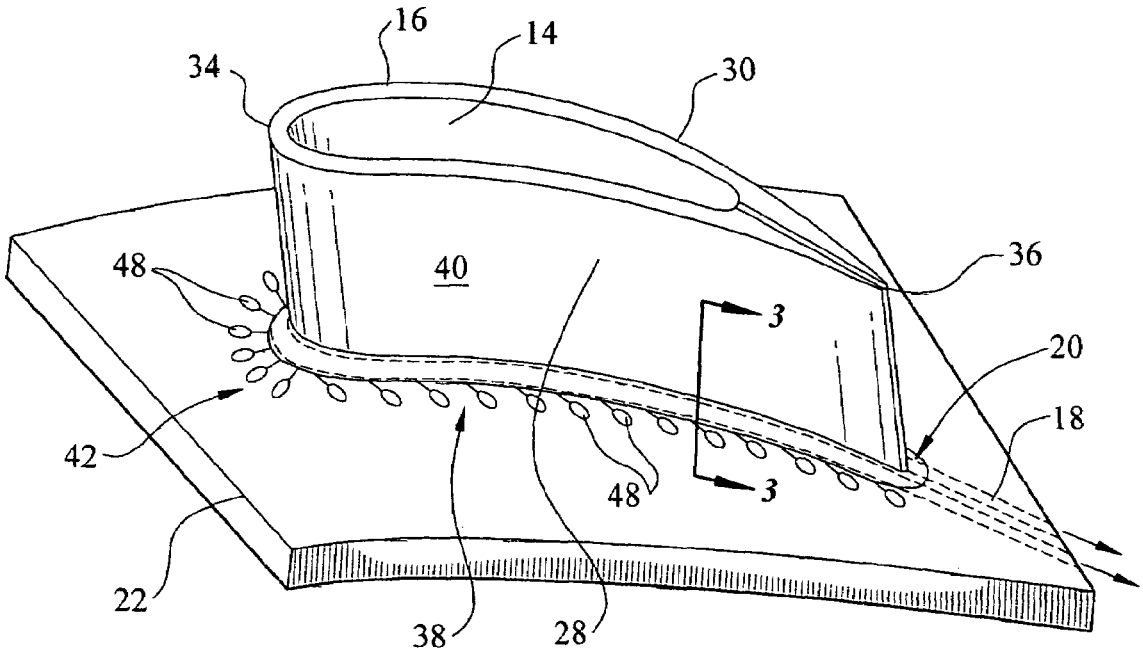
FIG. 2 is a cross-sectional view of the perspective view of FIG. 1 taken at 2—2.
Figure 3:
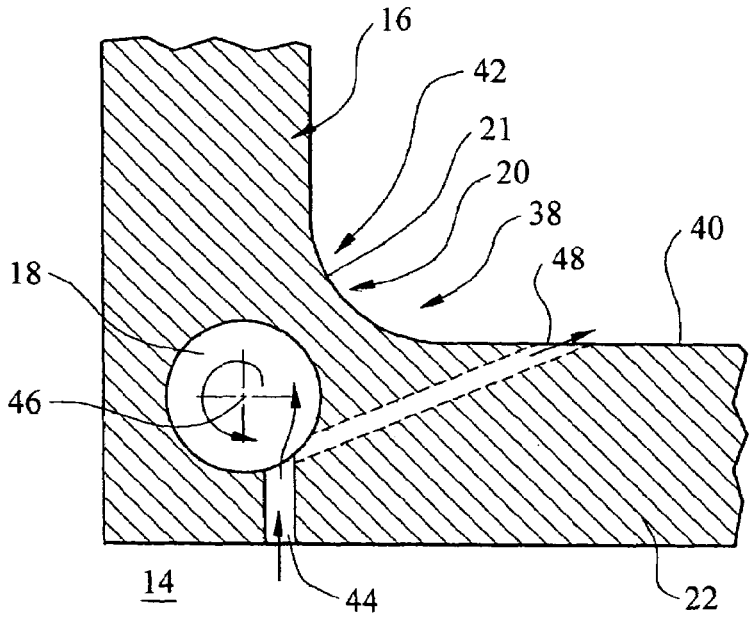
FIG. 3 is a cross-sectional view of a fillet region of the turbine vane shown in FIG. 2 taken at 3—3.

As shown in FIGS. 1–3, this invention is directed to a turbine vane cooling system 10 usable in internal cooling systems of turbine vanes 12 of turbine engines. In particular, turbine vane cooling system 10 is directed to a cooling system 10 formed at least from a cavity 14, as shown in FIG. 2, positioned between outer walls 16. The cooling system 10 may include one or more vortex forming chambers 18 for cooling aspects of the outer wall 16 at an intersection 20 between the outer wall 16 and an endwall 22. As shown in FIG. 1, the turbine vane 12 may be formed from a first endwall 22 at a first end 24 and a generally elongated airfoil 26 coupled to the first endwall 22 at the intersection 20 opposite a second endwall 23 at a second end 25. Intersection 20 may include a fillet 21 for providing a transition between the airfoil 26 and the first or second endwalls 22, 23. The fillet 21 may provide additional strength to the connection between the airfoil 26 and the first or second endwalls 22, 23. The airfoil 26 may have an outer wall 16 adapted for use, for example, in a first stage, or other stage, of an axial flow turbine engine. Outer wall 16 may have a generally concave shaped portion forming pressure side 28 and may have a generally convex shaped portion forming suction side 30.

The cavity 14, as shown in FIG. 2, may be positioned in inner aspects of the elongated airfoil 26 for directing one or more gases, which may include air received from a compressor (not shown), through the airfoil 26 and out one or more orifices 32 in the vane 20. As shown in FIG. 1, the orifices 32 may be positioned in a leading edge 34 or a trailing edge 36, or any combination thereof, and have various configurations. The orifices 32 provide a pathway for cooling fluids to flow from the cavity 14 through the outer wall 16. The cavity 14 may have one or a plurality of cavities and is not limited to a particular configuration for purposes of this invention. The cavity 14 may have various configurations capable of passing a sufficient amount of cooling fluids through the airfoil 26 to cool the airfoil 26 and other components.

The turbine vane cooling system 10 may also include one or more vortex forming chambers 18 proximate to the intersection 20 between the airfoil 26 and the first or second endwalls 22, 23. The following discussion will be directed to the intersection 20 at the first endwall 22. However, the same configuration may be present at the intersection 20 at the second endwall 23 as well. In at least one embodiment, as shown in FIG. 2, the vortex forming chamber 18 may be formed from one or more tubes at the perimeter 38 of the airfoil 26. The vortex forming chamber 18 may follow the perimeter 38 of the airfoil 26 and be generally parallel with an outer surface 40 of the first endwall 22. The vortex forming chamber 18 may have a generally cylindrical cross-section, as shown in FIG. 3, or other appropriate shape for reducing the amount of heat from the outer wall 16, and in particular, from the fillet 21. In embodiments of the airfoil 26 having a fillet 21 at the intersection 20, the vortex forming chambers 18 may be placed in the outer wall 16 in close proximity to the fillet 21 and to an outer surface 40 of the airfoil 26 in order to keep the temperature of the fillet region 42 below critical temperatures at which the airfoil 26 and endwalls 22, 23 are susceptible to damage.

The vortex forming chambers 18 may be feed with cooling fluids from one or more cooling injection holes 44 that provide at least one cooling fluid supply pathway between a cooling air supply cavity 15 at the end of the cavity 14 and the vortex forming chambers 18. The cooling injection holes 44 may be positioned around the perimeter 38 of the airfoil 26 equidistant from each other or in any other appropriate configuration to supply the vortex forming chambers 18 with cooling fluids. The cooling injection holes 44 may be sized to control the flow of cooling fluids into the vortex forming chambers 18. The cooling injection holes 44 may be coupled to the vortex forming chambers 18, as shown in FIG. 3, such that the cooling injection holes 44 are offset from a longitudinal axis 46 of the vortex forming chamber 18. In this configuration, cooling fluids entering the vortex forming chambers 18 strike an inner surface of the vortex forming chamber 18 and form a vortex therein.

Cooling fluids may be exhausted from the vortex forming chamber 18 through one or more film cooling holes 48. The film cooling holes 48 may provide a fluid pathway between the vortex forming chamber 18 and the outer surface 40 of the airfoil 26 and the first endwall 22. In at least one embodiment, the film cooling holes 48 may be positioned around the perimeter 38 of the airfoil 26. The film cooling holes 48 may be positioned in the first endwall 22, as shown in FIG. 3, in close proximity with the fillet 21. The film cooling holes 48 may be positioned in different configurations based upon the cooling needs of the airfoil 26 in which the turbine vane cooling system 10 is placed.

During operation, cooling fluids, such as, but not limited to, air, flow from the cooling air supply cavity 15 into one or more cooling injection holes 44. The cooling fluids flow through the cooling injection holes and into the vortex forming chambers 18 where the cooling fluids form vortices. The cooling fluids extract heat from the walls forming the vortex forming chamber, which in turn reduces the temperature of the intersection 20. In embodiments including fillets 21, the temperature of the fillet 21 is reduced as well. The cooling fluids may be exhausted from the vortex forming chambers 18 through one or more film cooling holes 48. While cooling fluids are exhausted from the vortex forming chambers 18, cooling fluids may also enter the vortex forming chambers 18 through the cooling injection holes 44. As the cooling fluids exit the vortex forming chambers 18 through the film cooling holes 48, the cooling fluids are exhausted proximate to the fillet 21 to cool the outside surfaces of the fillet 21 and the first endwall 22.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine vane, comprising:

a generally elongated airfoil having a leading edge, a trailing edge, a first endwall at a first end, a second endwall at a second end generally opposite the first end, at least one cavity forming a cooling system in the vane, and at least one outer wall defining the at least one cavity forming at least a portion of the cooling system;

wherein the cooling system comprises at least one vortex forming chamber in the outer wall of the vane that is located proximate to an intersection between the generally elongated airfoil and the first endwall for cooling the intersection between the generally elongated airfoil and the first endwall; and wherein the at least one vortex forming chamber comprises at least one tube positioned around the perimeter of the generally elongated airfoil and proximate to the intersection between the generally elongated airfoil and the first endwall.

2. The turbine vane of claim 1, wherein the at least one vortex forming chamber comprises at least one tube positioned around the perimeter of the generally elongated airfoil and proximate to the intersection between the generally elongated airfoil and the second endwall.

3. The turbine vane of claim 1, wherein the at least one tube has a generally cylindrical cross-section.

4. A turbine vane, comprising:

a generally elongated airfoil having a leading edge, a trailing edge, a first endwall at a first end, a second endwall at a second end generally opposite the first end, and an internal cooling system formed from at least ones cavity defined in pert by at least one outer wall;

wherein the cooling system comprises at least one tubular vortex forming chamber in the outer wall of the vane that is located proximate to a fillet positioned at an intersection between the generally elongated airfoil and the first endwall for cooling the intersection between the generally elongated airfoil and the first endwall.

5. The turbine vane of claim 4, wherein the at least one vortex forming chamber comprises at least one tube positioned around the perimeter of the generally elongated airfoil and proximate to the fillet at the intersection between the generally elongated airfoil and the first endwall.

6. The turbine vane of claim 5, wherein the at least one vortex forming chamber comprises at least one tube positioned around the perimeter of the generally elongated airfoil and proximate to the fillet at the intersection between the generally elongated airfoil and the second endwall.

7. The turbine vane of claim 5, wherein the at least one tube has a generally cylindrical cross-section.

8. The turbine vane of claim 4, further comprising at least one cooling injection hole providing at least one cooling fluid supply pathway between the at least one cavity forming at least a portion of the cooling system and the at least one vortex forming chamber for enabling cooling fluids to enter the vortex forming chamber.

9. The turbine vane of claim 8, wherein the at least one cooling injection hole directs cooling fluids into the vortex forming chamber in a direction offset from a longitudinal axis of the vortex forming chamber.

10. The turbine vane of claim 9, wherein the at least one cooling injection hole comprises a plurality of cooling injection holes around a perimeter of the generally elongated airfoil.

11. The turbine vane of claim 4, further comprising at least one film cooling hole extending from the at least one vortex forming chamber to an outer surface of the generally elongated airfoil.

12. The turbine vane of claim 11, wherein an outlet of the at least one film cooling hole is positioned in the endwall proximate to the fillet position at the intersection between the generally elongated airfoil and the endwall.

13. A turbine vane, comprising:

a generally elongated airfoil having a leading edge, a trailing edge, a first endwall at a first end, a second endwall at a second end generally opposite the first end, at least one cavity forming a cooling system in the vane, and at least one outer wall defining the at least one cavity forming at least a portion of the cooling system;

wherein the cooling system comprises at least one vortex forming chamber in the outer wall of the vane that is located proximate to an intersection between the generally elongated airfoil and the first endwall for cooling the intersection between the generally elongated airfoil and the first endwall; and at least one cooling injection hole providing at least one cooling fluid supply pathway between the at least one cavity forming at least a portion at the cooling system and the at least one vortex forming chamber for enabling cooling fluids to enter the vortex farming chamber.

14. The turbine vane of claim 13, wherein the at least one cooling injection hole directs cooling fluids into the vortex forming chamber in a direction offset from a longitudinal axis at the vortex forming chamber.

15. The turbine vane of claim 14, wherein the at least one cooling injection hole comprises a plurality of cooling injection holes around a perimeter of the generally elongated airfoil.

16. A turbine vane, comprising:

a generally elongated airfoil having a leading edge, a trailing edge, a first endwall at a first end, a second endwall at a second end generally opposite the first end, at least one cavity forming a cooling system in the vane, and at least one outer wall defining the at least one cavity forming at least a portion of the cooling system;

wherein the cooling system comprises at least one vortex forming chamber in the outer wall of the vane that is located proximate to an intersection between the generally elongated airfoil and the first endwall for cooling the intersection between the generally elongated airfoil and the first endwall; and at least one film cooling hole extending from the at least one vortex forming chamber to an outer surface of the generally elongated airfoil.

17. The turbine vane of claim 16, wherein an outlet of the at least one film cooling hole is positioned in the endwall proximate to the intersection between the generally elongated airfoil and the endwall.

* * * * *